US007701142B2

(12) United States Patent
Scholz et al.

(10) Patent No.: US 7,701,142 B2
(45) Date of Patent: Apr. 20, 2010

(54) CERAMIC HID ARC TUBE ASSEMBLY

(75) Inventors: John A. Scholz, Georgetown, MA (US); Kevin Provagna, Medina, OH (US)

(73) Assignee: OSRAM SYLVANIA Inc., Danvers, MA (US)

( * ) Notice: Subject to any disclaimer, the term of this patent is extended or adjusted under 35 U.S.C. 154(b) by 204 days.

(21) Appl. No.: 11/986,591

(22) Filed: Nov. 23, 2007

(65) Prior Publication Data

US 2009/0134760 A1 May 28, 2009

(51) Int. Cl.
*H01J 17/16* (2006.01)
*H01J 61/30* (2006.01)

(52) U.S. Cl. ..... 313/634; 313/484; 313/567; 313/318.01

(58) Field of Classification Search ..... 313/483, 313/484, 493, 567, 573, 634, 318.01
See application file for complete search history.

(56) References Cited

U.S. PATENT DOCUMENTS 5,252,885 A * 10/1993 Muzeroll et al. ..... 313/25
6,249,077 B1 * 6/2001 Brown et al. ..... 313/25
6,628,080 B1 9/2003 McCullough
6,741,034 B2 5/2004 Scholz
6,858,976 B2 2/2005 McCullough
7,135,811 B2 11/2006 Scholz
2004/0174121 A1 * 9/2004 Tsuda et al. ..... 313/635
2004/0178715 A1 * 9/2004 Williamson et al. .... 313/318.03
2007/0080620 A1 * 4/2007 Wyner et al. ..... 313/318.01
2007/0194683 A1 * 8/2007 Serita et al. ..... 313/242

* cited by examiner

*Primary Examiner*—Toan Ton
*Assistant Examiner*—Kevin Quarterman
(74) *Attorney, Agent, or Firm*—Edward S. Podszus

(57) ABSTRACT

An arc tube assembly (10) for a protected high intensity discharge lamp. The assembly has a ceramic arc tube (12) with a short shroud (20) surrounding at least the arc chamber (14) of the arc tube. The short shroud (20) allows the frit seal areas (46) of the arc tube capillaries (18) to project beyond the shroud (20) and thereby operate at a lower temperature, thus increasing lamp life.

8 Claims, 2 Drawing Sheets

CERAMIC HID ARC TUBE ASSEMBLY

TECHNICAL FIELD

This invention relates to lamps and particularly to arc discharge lamps. Still more particularly, the invention relates to arc discharge lamps employing a ceramic arc tube, a shroud and mounting means for mounting said arc tube within the shroud.

BACKGROUND ART

Metal halide arc discharge lamps are frequently employed in commercial usage because of their high luminous efficacy and long life. A typical metal halide arc discharge lamp includes a quartz or fused silica arc tube that is hermetically sealed within a borosilicate glass outer envelope. Recent advances in the art have employed a ceramic arc tube constructed, for example, from polycrystalline alumina. It is with the latter type that this invention is particularly concerned. The arc tube, itself hermetically sealed, has tungsten electrodes sealed into opposite ends and contains a fill material that may include mercury, metal halide additives and a rare gas to facilitate starting. In some cases, particularly in high wattage lamps, the outer envelope is filled with nitrogen or another inert gas at less than atmospheric pressure. In other cases, particularly in low wattage lamps, the outer envelope is evacuated.

It has been found desirable to provide metal halide arc discharge lamps with a shroud that comprises a generally tubular, light-transmissive member, such as quartz, that is able to withstand high operating temperatures. The arc tube and the shroud are coaxially mounted within the lamp envelope with the arc tube located within the shroud. Preferably, the shroud is a tube that is open at both ends.

The shroud or shield has several beneficial effects on lamp operation. In lamps with a gas-filled outer envelope, the shroud reduces convective heat losses from the arc tube and thereby improves the luminous output and the color temperature of the lamp. In lamps with an evacuated outer envelope, the shroud helps to equalize the temperature of the arc tube. In addition, the shroud effectively reduces sodium losses and improves the maintenance of phosphor efficiency in metal halide lamps having a phosphor coating on the inside surface of the outer envelope. Finally, the shroud improves the safety of the lamp by acting as a containment device in the event that the arc tube shatters.

In lamps using ceramic arc tubes, mounting the arc tube within a shroud has proven difficult and expensive. The ceramic arc tube has a tubular or bulbous body with ceramic, cylindrical capillaries extending therefrom. The capillaries are relatively small, often having diameters of 3 mm or so, and contain the electrodes. A number of techniques have been devised for solving the mounting problems of ceramic arc tubes as shown in U.S. Pat. Nos. 6,628,080; 6,741,034; 6,858,976; and 7,135,811, all of which are assigned to the assignee of the instant invention. Of these, U.S. Pat. No. 6,741,034 also teaches a starting aid in conjunction with a mounting clip and the teachings of the '034 are hereby incorporated by reference.

While the structures shown in the above-cited references have proven commercially successful, nevertheless, lamps so constructed have life spans shorter than anticipated. Often, this shortened lifetime is caused by cracks developing in the frit seal that fixes the electrode within the capillary.

DISCLOSURE OF INVENTION

It is, therefore, an object of the invention to obviate the disadvantages of the prior art.

It is another object of the invention to enhance high intensity discharge lamps.

Yet another object of the invention is the improvement of the life expectancy of ceramic arc tube high intensity discharge lamps.

These objects are accomplished, in one aspect of the invention, by the provision of an arc tube assembly comprising: an arc tube having an arc chamber with a longitudinal length "X" extending along a longitudinal axis: a cylindrical electrode capillary at each end of the arc tube extending along the longitudinal axis; a cylindrical shroud surrounding the arc tube chamber; and clips supporting the arc tube within the shroud, the shroud having a length such that a substantial portion of each of the capillaries projects beyond the shroud.

By positioning the frit seal portions of the capillaries outside the shroud, the temperatures to which those frit seals are subjected are reduced and the likelihood of shortened lamp life from seal failure is reduced or eliminated.

BEST MODE FOR CARRYING OUT THE INVENTION

For a better understanding of the present invention, together with other and further objects, advantages and capabilities thereof, reference is made to the following disclosure and appended claims taken in conjunction with the above-described drawings.

Figure 2:
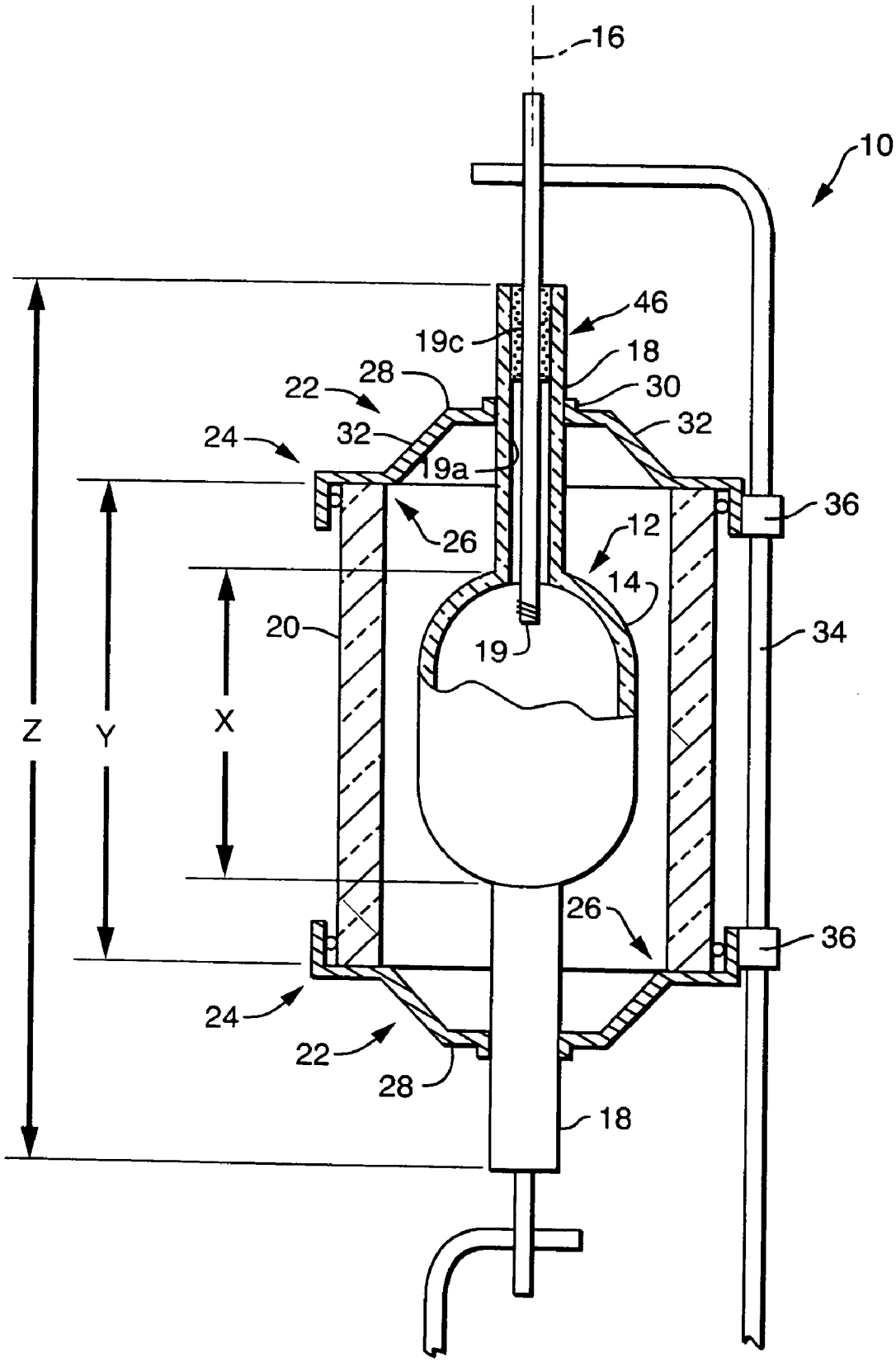
FIG. 2 is an elevation view, partially in section, of an arc tube assembly in accordance with an aspect of the invention.

Referring now to the drawings with greater particularity, there is shown in FIG. 2 an arc tube assembly 10 comprising an arc tube 12 having an arc chamber 14 with a longitudinal length "X" extending along a longitudinal axis 16. A cylindrical electrode capillary 18 projects from each end of the arc tube 12 and extends along the longitudinal axis 16, the arc chamber and capillaries having an overall length "Z". The arc tube 12 and the capillaries are formed from a suitable ceramic, for example, poly crystalline alumina. Electrodes 19 are sealed into the bore 19*a* of the capillaries 18 by a glass frit 19*c*, in a frit seal area 46. It is the frit seal area where life-limiting reactions can take place when the lamp is operating. For example, when the lamp operates, a plasma discharge at very high temperature occurs between the two electrodes of the lamp. The capillary areas of the lamp, when covered by the shroud, can approach temperatures of 1000° C. These temperatures, over time, adversely affect the integrity of the seals, causing the seals to react with the hot plasma and form microscopic cracks or fissures within the frit. The cracks or fissures cause leakage of the arc tube contents. Further, it can lead to cracks in the capillary and thereby shorten lamp life.

A cylindrical shroud 20 surrounds the arc tube chamber 14, the shroud 20 having a length about 1.45X and 0.57Z. The shroud 20 is formed from a transparent heat resistant material, for example, quartz or fused silica.

In a particular example the shroud for a 100 w lamp according to an aspect of the invention has a length of 23 mm, whereas previously employed shrouds for similar lamps had lengths ranging from 40 to 48 mm.

The arc tube 12 is held in a centrally located position within the shroud 20 by a shroud clip 22 positioned at each end of the shroud 20. Each shroud clip 22 comprises a peripheral edge 24 engaging an end 26 of the shroud 20 and a center portion 28 spaced away from the peripheral edge 24 and extending away from the arc chamber 14. A capillary engager 30, such as cylindrical aperture 31, is formed in the center portion 28 and engages a capillary 18. A web 32 connects the center portion 28 to the peripheral edge 24. Preferably, the clips 22 are formed from 301 stainless steel flat wire having a hardness of 40 to 50 on the Rockwell "C" scale.

Figure 1:
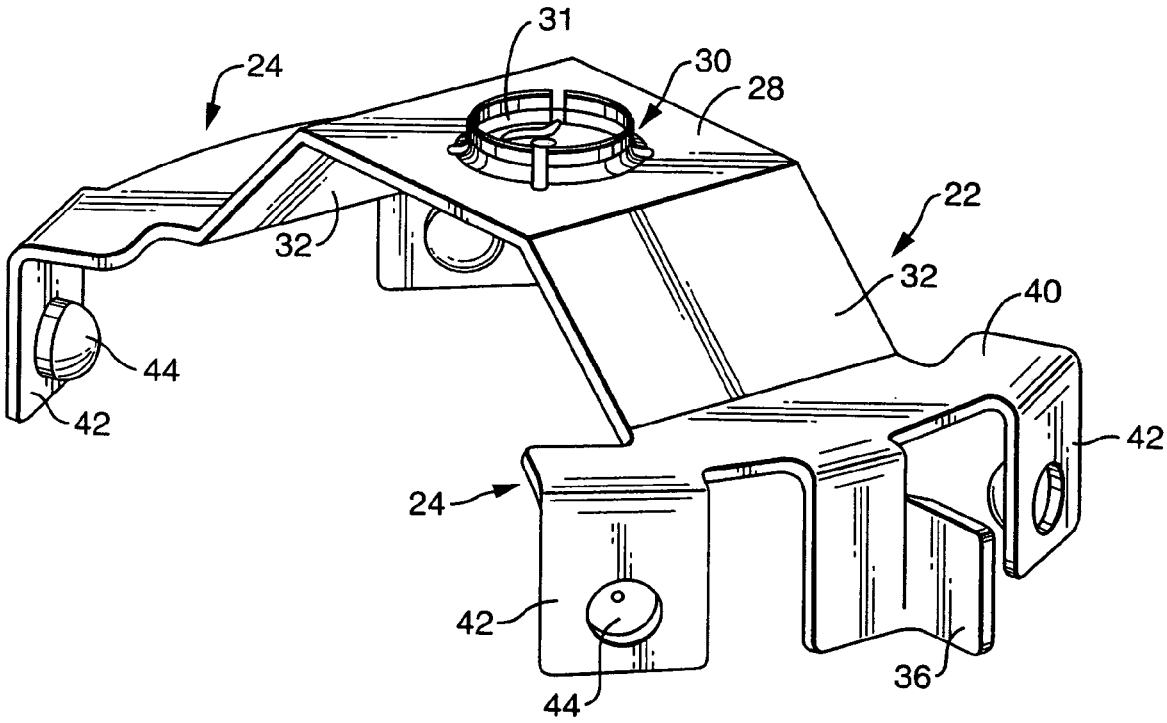
FIG. 1 is a perspective view of a clip in accordance with an aspect of the invention.

The peripheral edge 24 of the clip 22, as shown more clearly in FIG. 1, comprises a lateral section 40 with depending arms 42. The arms 42 can be provided with dimples 44 to minimize the contact area with the shroud 20.

The clips 22 are provided also with tabs 36 that extend away from the longitudinal axis 16 and attach, as by welding, to a frame 34 that can be in the form of a wire that extends parallel to the longitudinal axis 16. The frame 34 can provide one of the electrode power lead-ins.

This construction positions the frit seal area 46 well outside the edges of the shroud 20 and reduces the temperatures to which the frit seal area is subjected during lamp operations.

Tests have shown that lamps equipped with shrouds of the prior art having a length sufficient to encompass the frit seal area, when operated base up, have temperatures at the seal area that is uppermost that range from 854 to 938° C. and temperatures at the seal area that is lowermost that range from 817 to 884° C. Conversely, tests with lamps employing the arc tube assembly described herein had comparable temperatures of 839° C. and 793° C., a vast improvement.

While it is possible to lower these temperatures even further by operating the lamps without a shroud, such lamps must be operated within a protected fixture that greatly increases the cost of operation.

Thus there is provided a high intensity discharge, protected lamp having enhanced operation.

While there have been shown and described what are at present considered to be the preferred embodiments of the invention, it will be apparent to those skilled in the art that various changes and modifications can be made herein without departing from the scope of the invention as defined by the appended claims.

What is claimed is:

1. An arc tube assembly comprising:

an arc tube having an arc chamber with a longitudinal length "X" extending along a longitudinal axis:

a cylindrical electrode capillary at each end of said arc tube extending along said longitudinal axis;

a cylindrical shroud surrounding said arc tube chamber, said shroud having a length about 1.45X;

a shroud clip at each end of said shroud, each shroud clip comprising a peripheral edge engaging an end of said shroud, a center portion spaced away from said peripheral edge and extending away from said arc chamber;

a capillary engager formed in said center portion and engaging a capillary; and a web connecting said center portion to said peripheral edge.

2. The arc tube assembly of claim 1 wherein said assembly includes a frame extending parallel to said longitudinal axis and each of said shroud clips includes a tab affixed to said frame.

3. The arc tube assembly of claim 1 wherein said shroud clip peripheral portion comprises a lateral section and depending arms.

4. The arc tube assembly of claim 3 wherein said depending arms are provided with contact dimples.

5. The arc tube assembly of claim 1, comprising a plurality of said clips contacting said shroud.

6. An arc tube assembly comprising:

an arc tube having an arc chamber with a longitudinal length "X" extending along a longitudinal axis:

a cylindrical electrode capillary at each end of said arc tube extending along said longitudinal axis, said arc chamber and said capillaries having a total length "Z";

a cylindrical shroud having a longitudinal length "Y" surrounding said arc tube chamber; and clips supporting said arc tube within said shroud, said shroud being spaced from at least one of said capillaries, said shroud length Y being greater than X and less than Z, whereby a substantial portion of each of said capillaries projects beyond said shroud.

7. The arc tube assembly of claim 6, wherein said shroud is spaced from each of said capillaries.

8. An arc tube assembly comprising:

an arc tube having an arc chamber with a longitudinal length "X" extending along a longitudinal axis:

a cylindrical electrode capillary at each end of said arc tube extending along said longitudinal axis, said arc chamber and said capillaries having a total length "Z";

a cylindrical shroud having a longitudinal length "Y" surrounding said arc tube chamber; and at least one clip supporting said arc tube within said shroud, said at least one clip extending between said shroud and at least one of said capillaries and contacting both said shroud and said at least one of said capillaries, said shroud length Y being greater than X and less than Z, whereby a substantial portion of each of said capillaries projects beyond said shroud.

* * * * *